US005151173A

United States Patent [19]

Vaughn et al.

[11] Patent Number: 5,151,173

[45] Date of Patent: Sep. 29, 1992

[54] CONVERSION OF COAL WITH PROMOTED CARBON MONOXIDE PRETREATMENT

[75] Inventors: Stephen N. Vaughn, Baton Rouge, La.; Michael Siskin, Livingston, N.J.; Alan Katritzky, Gainesville, Fla.; Glen Brons, Phillipsburg, N.J.; Steve N. Reynolds, Baton Rouge, La.; Claude C. Culross, Baton Rouge, La.; Dan R. Neskora, Baton Rouge, La.

[73] Assignee: Exxon Research and Engineering Company, Florham Park, N.J.

[21] Appl. No.: 455,658

[22] Filed: Dec. 21, 1989

[51] Int. Cl.[5] ..... C10G 1/06

[52] U.S. Cl. ..... 208/430; 208/414; 208/419; 208/420; 208/428; 208/435

[58] Field of Search ..... 208/430, 433, 427, 435

[56] References Cited

U.S. PATENT DOCUMENTS

| | | | |
|---|---|---|---|
| 3,642,607 | 2/1972 | Seitzer | 208/433 |
| 3,796,650 | 3/1974 | Urban . | |
| 3,808,119 | 4/1974 | Bull et al. | 208/433 |
| 3,846,275 | 11/1974 | Urban . | |
| 3,884,796 | 5/1975 | Hinderliter et al. . | |
| 3,909,390 | 9/1975 | Urban . | |
| 3,920,536 | 11/1975 | Seltzer et al. . | |
| 3,930,984 | 1/1970 | Pitchford | 208/433 |
| 4,028,220 | 6/1977 | Urquhart . | |
| 4,077,867 | 3/1978 | Aldridge et al. | 208/421 X |
| 4,128,471 | 12/1978 | Malone et al. . | |
| 4,144,033 | 3/1979 | Nakako et al. . | |
| 4,260,471 | 4/1981 | Miller | 208/433 |
| 4,298,451 | 11/1981 | Neuworth | 208/433 X |
| 4,330,390 | 5/1982 | Rosenthal et al. | 208/430 X |
| 4,338,183 | 7/1982 | Gatsis | 208/430 |
| 4,491,511 | 1/1985 | Skinner et al. | 208/433 X |
| 4,523,980 | 6/1965 | Seufert | 208/427 |
| 5,026,475 | 6/1991 | Stuntz et al. | 208/403 |

FOREIGN PATENT DOCUMENTS

| | | | |
|---|---|---|---|
| 1232219 | 2/1988 | Canada . | |
| 0264743 | 4/1988 | European Pat. Off. | 208/433 |

OTHER PUBLICATIONS

S. D. Brandes, et al.,; *Coal Pretreatment, Chemistry and Technology*; U.S. Dept. of Energy, Pittsburgh, PA 15236; SRI International, Menlo Park, Calif. 94025.

EP-311-164-A, Single-step coal liquefaction process-using carbon monoxide, aq. alkali for hydrogen prodn. by conversion, and a transition metal hydrogenation catalyst.

*Primary Examiner*—Anthony McFarlane

*Attorney, Agent, or Firm*—C. P. Konkol; Henry E. Naylor

[57] ABSTRACT

This invention is directed to a process for pretreating coal preliminary to a primary liquefaction or hydroconversion block. In the process, a coal feed, slurried in a solvent, is reacted with carbon monoxide in the presence of a chemical promoter at an elevated temperature and pressure. The promoter enhances the depolymerization and hydrogenation of the coal during pretreatment.

16 Claims, 8 Drawing Sheets

CONVERSION OF COAL WITH PROMOTED CARBON MONOXIDE PRETREATMENT

This invention relates to a process for pretreatment of a coal feed prior to catalytic hydro-conversion of the coal to produce liquid hydrocarbon products. In particular, the present process comprises subjecting a coal feed, slurried in a solvent, to carbon monoxide and an effective amount of a promoter compound. The promotor enhances the pretreatment reactions which hydrogenate and solubilize the coal. Various promoters, including formate salts, are disclosed.

BACKGROUND OF THE INVENTION 1. Field of the Invention

The petroleum industry has long been interested in the production of "synthetic" liquid fuels from non-petroleum solid fossil fuel sources. It is hoped that economic non-petroleum sources of liquid fuel will help the petroleum industry to meet growing energy requirements and decrease dependence on foreign supplies.

Coal is the most readily available and most abundant solid fossil fuel, others being tar sands and oil shale. The United States is particularly richly endowed with well distributed coal resources. Additionally, in the conversion of coal to synthetic fuels, it is possible to obtain liquid yields of about three to four barrels per ton of dry coal, or about four times the liquid yield/ton of other solid fossil fuels such as tar sands or shale, because these resources contain a much higher proportion of mineral matter.

Despite the continued interest and efforts of the petroleum industry in coal liquefaction technology, further improvements are necessary before it can reach full economic status. Maximizing the yield of coal liquids is important to the economics of coal liquefaction.

The present invention relates to an improved process for converting coal to liquid hydrocarbon products in a catalytic hydroconversion process. The improvement relates to a coal pretreatment stage comprising subjecting the coal to aqueous carbon monoxide in the presence of a promotor under specific pressure and temperature conditions. Such pretreatment improves the reactivity of the coal in the subsequent liquefaction stage of the overall process. Various promoters enhance the hydrogenation and depolymerization of the coal during pretreatment. The promoters disclosed herein include certain organic acids and salts of organic acids. 2. Description of the Prior Art The known processes for producing liquid fuels from coal can be grouped into four broad categories: direct hydrogenation, donor solvent hydrogenation, Fischer-Tropsch synthesis (via gasification), and pyrolysis (see Kirk Othmer - Fuels). The present invention falls into the category of direct hydrogenation.

The direct hydrogenation of coal in the presence of solvent and catalyst was first developed in Germany prior to World War II. In such a process, a slurry of coal in a suitable solvent was reacted in the presence of molecular hydrogen at an elevated temperature and pressure.

A number of previous co-assigned patents disclose coal liquefaction processes utilizing hydroconversion catalysts which are micron sized particles comprised of a metal sulfide in a carbonaceous matrix. These catalysts are generally formed from certain soluble or highly dispersed organometallic compounds or precursors.

These precursors are converted into catalyst particles by heating in the presence of an hydrogen containing gas. The catalyst particles are highly dispersed in the feed being treated during hydroconversion. Among the various patents in this area are U.S. Pat. No. 4,077,867; U.S. Pat. No. 4,094,765; U.S. Pat. No. 4,149,959; U.S. Pat. No. 4,298,454; and U.S. Pat. No. 4,793,916. Other patents disclose catalysts similar to the above except that the catalytically active metal compound is supported on finely divided particles of solid metals and metal alloys, for example as disclosed in U.S. Pat. Nos. 4,295,995 and 4,357,229.

The conversion of coal in aqueous/CO is well known, dating back to Fischer and Schrader in 1921 (F. Fisher & H. Schrader, Bennst. Chem., 2, 257, 1921). Several liquefaction processes, including the U.S. Bureau of Mines COSTEAM process (H. R. Appell, E. C. Moroni, R. D. Miller, Energy Sources, 3, 163, (1971), have been developed based on using aqueous/CO or aqueous/syngas at 750°-850° F. in the primary conversion block for lignites (low rank coals).

An object of the present invention is to provide an improved process for the conversion of carbonaceous solids such as coal in order to produce valuable liquid hydrocarbonaceous products.

A further object of the present invention is to provide an improved process for producing liquid hydrocarbonaceous products from coal, the improvement comprising utilizing a pretreatment step wherein the coal, slurried in an aqueous or organic solvent, is subjected to reaction with carbon monoxide in the presence of a promoter compound to enhance hydrogenation and/or depolymerization of the coal.

A particular object of the present invention is to pretreat coal in a specific temperature range to generate a more reactive coal for coal liquefaction, thereby obtaining more products, with higher selectivity to liquids over gases.

Another object of the present invention is to improve the efficiency in the utilization of molecular hydrogen in the transformation of coal to valuable liquids.

Another object of the present invention is to reduce the investment necessary for building a coal liquefaction plant and/or to increase the capacity of such a plant by permitting a lower average residence time for coal treatment and conversion.

Additional advantages of the present coal conversion process will become apparent in the following description.

SUMMARY OF THE INVENTION

In accordance with the present invention, there is provided a process for pretreatment of coal preliminary to catalytic hydroconversion of coal to a hydrocarbonaceous liquid, which pretreatment comprises forming a mixture comprising coal, carbon monoxide, solvent and an effective amount of a promoter compound, and subjecting the mixture to a temperature and pressure effective to cause hydrogenation and depolymerization of the coal, wherein the promoter compound is an acid, or an ammonium, zinc (Group IIB), alkali (Group IA), or alkaline earth (Group IIA) metal salt of an acid or base. One preferred class of promoters are hydrogen sulfide or ammonium salts of hydrogen sulfide, including ammonium sulfide or bisulfide.

In accordance with another embodiment of the present invention, there is provided a process for liquifying coal to produce an oil, which comprises: (a) pretreating the coal by forming a mixture comprising coal, carbon monoxide, solvent, and an effective amount of a promoter compound, and subjecting the mixture to an elevated temperature and pressure; (b) removing gases from the coal mixture; (c) forming a subsequent mixture of pretreated coal material, and catalyst, wherein the catalyst is a carbonaceous supported metal containing oxide or sulfide and has an average particle size of 0.02 to 2.0 μm, preferably a conversion product of an oil-soluble metal containing compound, said metal being selected from the group consisting of Groups VA, VIA, VIIA and VIIIA of the Periodic Table of Elements; (d) reacting the latter mixture with a gas largely comprised of molecular hydrogen under coal liquefaction conditions, in a hydroconversion zone; and (e) recovering an oil product. Prior to hydroconversion in step (d), it is optional to extract the pretreated coal, in which case the coal material in step (c) is a coal extract, separated from the unextracted solid ash containing residue.

BRIEF DESCRIPTION OF DRAWINGS

The process of the invention will be more clearly understood upon reference to the detailed discussion below and upon reference to the drawings wherein.

DESCRIPTION OF THE PREFERRED EMBODIMENTS

Figure 1:
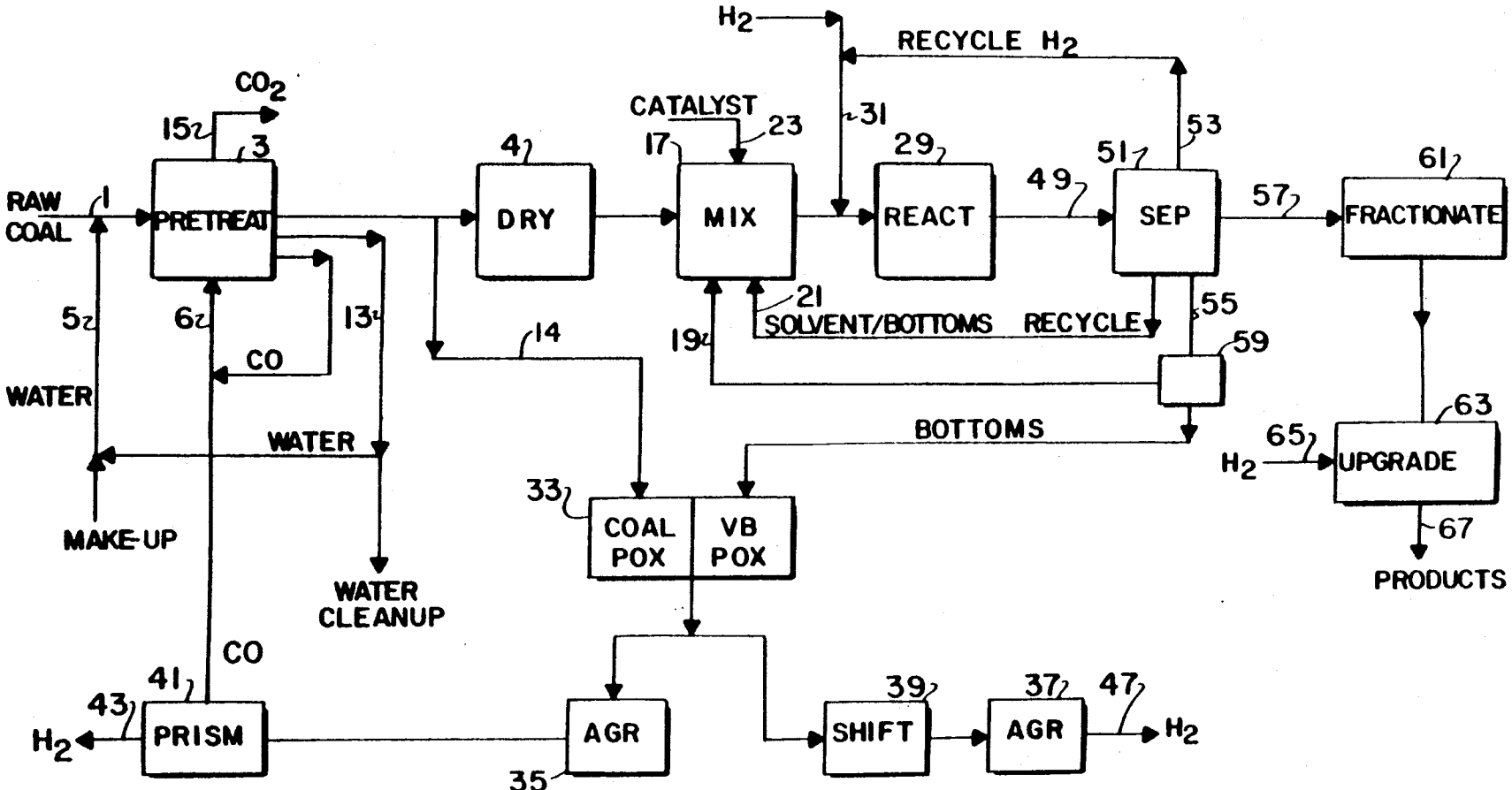
FIG. 1 shows a process flow diagram illustrating the subject invention wherein coal is pretreated in the presence of aqueous carbon monoxide and thereafter converted into valuable liquids.

The present process of the invention is generally applicable to processes for hydroconverting coal to coal liquids (i.e., an oil or normally liquid hydrocarbon product) under catalytic hydroconversion conditions. The present invention is directed to a pretreatment stage prior to a liquefaction stage, and in particular, to the use of a promoter compound to enhance the pretreatment of the coal.

The term "coal" is used herein to designate a normally solid carbonaceous material including all ranks of coal below anthracite, such as bituminous coal, sub-bituminous coal, lignite, peat and mixtures thereof. The sub-bituminous and lower ranks of coal are particularly preferred.

The raw material for the present process is coal that has been first reduced to a particulate or comminuted form. The coal is suitably ground or pulverized to provide particles of a size ranging from 10 microns up to about ¼ inch particle size diameter, typically about 8 mesh (Tyler).

According to the present process, the coal feedstock is pretreated by being subjected to carbon monoxide in the presence of a promoter compound. Coal is reacted in the pretreatment stage at relatively mild temperatures. A limited amount of volatile hydrocarbon liquids are produced during the pretreatment stage (typically less than about 10% by weight). However, the coal is hydrogenated and depolymerized, and the moisture and oxygen levels are reduced. After such pretreatment, not only are the properties of the coal upgraded, but the coal shows enhanced reactivity for further processing. In particular, the pretreatment significantly increases the coal's value as feedstock for coal liquefaction. The severity of the coal liquefaction conditions can be reduced while increasing liquid yields and selectivity to light liquids, reducing gas make, and lowering hydrogen consumption. The coal can reach a significantly higher daf wt% (dry ash free weight percent) conversion following pretreatment.

Unlike most hydroconversion systems, which are based on thermal/free radical chemistry, the aqueous chemistry of the present pretreatment stage is generally believed to operate through an ionic mechanism, particularly when the coal is slurried in an aqueous solvent. Studies have indicated dual independent reaction pathways in the pretreatment step: (1) an hydrogenation pathway which results in an increased H/C (hydrogen to carbon) ratio and increased volatile matter content and; (2) an acid catalyzed bond breaking pathway that generates a soluble extractable product. (The terms "soluble" and "extractable" are used interchangeablyherein.) In the first pathway, the mechanism which was proposed by H. R. Appell (H. R. Appell, R. D. Miller, R. G. Illig, R. C. Moroni, F. W. Steffgen, Report PETC/TR-79/1, 1979) is still widely accepted, wherein the active intermediate is a formate-type anion which is formed by the addition of base into the system, as follows:

$$CO + OH^- \longrightarrow HCO_2^-$$

$$HCO_2^- + [COAL] \longrightarrow [COAL]H^- + CO_2$$

$$[COAL]H^- + H_2O \longrightarrow [COAL]H_2 + OH^-$$

$$H_2O + CO + [COAL] \longrightarrow [COAL]H_2 + CO_2$$

Thus, donatable hydrogen is incorporated into the coal. For example, hydrogenation of ring systems in the coal matrix to form hydroaromatics is thought to be facilitated. Hydroaromatics comprise one class of compounds that can donate hydrogen to cap free radicals during liquefaction and thus mitigate undesirable condensation reactions which yield less reactive bottoms. This hydrogenation of the coal during pretreatment appears to be a major factor responsible for its enhanced reactivity. The pretreatment has the effect of increasing the volatile matter content of the coal. In general, increased volatile matter content corresponds to more highly reactive coals during subsequent liquefaction. The pretreated coal appears to behave during subsequent coal liquefaction like unpretreated raw coal having the same volatile matter content. For example, pretreatment according to the present invention can make low rank coals behave like bituminous coals by reducing the water and oxygen levels prior to liquefaction as well as hydrogenating the coal and increasing the volatile matter, thereby increasing the barrels per ton yield. This is economically quite significant since, for example, a Wyoming sub-bituminous coal may be only about 30 percent the cost of an Illinois bituminous coal, and a Victorian brown coal may only be about 20 percent the cost of an Illinois bituminous coal, on a dollar per MBTU basis.

In the second reaction pathway mentioned above occurring during coal pretreatment, coal depolymerization reactions occur. Depolymerization is detected by an increased solubility in various sol vents. The increased solubility as a result of pretreatment may also enhance reactivity during liquefaction. The role of the carbon monoxide pretreatment in depolymerizing coal is not well understood and has been the subject of some work in the literature. The ability to depolymerize coal has been variously attributed to bond breaking activity, or to the removal of potential cross-link sources which cause repolymerization to higher molecular weight products following thermal bond rupture. The major depolymerization reactions are thought to be acid catalyzed, wherein water is believed to act as an acid catalyst. The acidic functionalities and acidic minerals in the coal as well as soluble acidic products which are generated during the pretreatment are believed to act synergistically to enhance conversion.

Particularly when an aqueous solvent is employed during pretreatment, much of the aqueous chemistry involved in carbon monoxide coal pretreatment is believed to involve oxygen-containing substituents attached to aromatic ring systems. The aqueous CO pretreatment is especially effective with oxygen rich coals. The pretreatment promotes decarboxylation of the coal and there is evidence that it also promotes some ether and ester cleavage in the coal.

Pretreatment of coal according to the present invention is suitably carried out in a reactor of conventional construction and design capable of withstanding the hereafter described conditions of pretreatment. A stainless steel cylindrical vessel with inlet lines for the coal slurry and carbon monoxide and product removal lines is suitable.

The pretreatment process conditions can have a large impact on the results. For example, when employing an aqueous solvent, it is economically desirable to minimize the "at conditions" (operating conditions) liquid water-to-dry coal weight ratio ("at conditions", as compared to "inlet conditions", excludes water evaporated t steam, and water lost via the water gas shift reaction). However, if water is employed to slurry the coal, a weight ratio of liquid water to dry coal of at least about 0.5:1 is required. If the ratio is below this value, the product coal properties are poor. In such a case, the preferred "at condition" ratio is about 0.5:1 to 2:1, most preferably above 1:1, and the preferred inlet ratio is about 1.25:1 to 4:1, most preferably 1.5:1 to 2:1, and at least 1:1.

When employing an aqueous solvent, it is desirable to minimize the amount of water which will be heated up in the pretreatment reactor. Therefore, the coal is fed into the reactor at the minimum pumpable water/solid ratio, which is about 1.25/1 on a weight basis (while simultaneously maintaining at least 0.5:1 in the reactor). The limit for pumpability will be variable and dependent upon the physical properties of a given coal. Similarly, there are a number of economic incentives for minimizing the carbon monoxide treat rate in the pretreatment reactor, including reducing the amount of water which would be flashed during the separation step, and decreasing compression and gas cleanup requirements.

In another preferred embodiment of the pretreatment stage, an added organic solvent, immiscible or miscible with water, is employed to enhance coal dispersion and flowability. An organic solvent helps prevent the pretreated coal from agglomerating and plugging vessels and lines in a continuous processing scheme. Suitable co-solvents include, but are not limited to, alcohols such as isopropyl alcohol, ketones, phenols, carboxylic acids, and the like. By-products of the pretreatment stage, concentrated and accumulated in a recycle water stream are a readily available source of such organic compounds. The ratio of organic solvent-to-dry coal is preferably about 0.25:1 to 2:1.

In another embodiment of the present process, coal particles are dispersed in an organic solvent phase which serves to transport carbon monoxide to the coal material during pretreatment. Co-assigned U.S. patent application Nos. 07/455,653 and 07/455,657, both filed Dec. 21, 1989 filed concurrently herewith discloses this embodiment in greater detail and is hereby incorporated by reference. Although the presence of bulk water in addition to organic solvent does not adversely affect the benefits of pretreatment (increased coal volatile matter and improved reactivity during hydroconversion), it is preferred that the coal particles are dispersed in a single liquid phase comprising an organic solvent such as a coal distillate.

When employing an organic solvent to slurry the coal particles, some water is required for the pretreatment reaction system in order to provide for hydrogenation of the coal material. However, the water may be provided by the as-received coal equilibrium moisture (also called "physical water") and/or by chemical water in the coal ("chemical water" is water made available during the conditions of pretreatment and may comprise water of hydration in the coal minerals).

In practice, when employing an organic solvent during pretreatment, no water is required to be added to the as-received coal, and no liquid water phase is necessary. Typically, about 30% by weight water may be present as moisture in the as-received coal, but this is insufficient to form an aqueous phase during pretreatment. Higher amounts of water, for example, in lignite, may be present and, although not preferred, is generally not detrimental to pretreatment. However, hydroconversion reactivity of the coal may suffer when both organic solvent and water are present at intermediate levels.

A major benefit of employing an organic solvent during pretreatment is that, since additional water is not required, no separation by fultration of liquid water from the pretreated coal is necessary, after it exits the pretreatment reactor. Separation of water from the pretreated coal suitably occurs in the gas phase by interstage gas separation rathern than by filtration.

When employing an organic solvent to slurry the coal, the ratio by weight of organic solvent-to-dry coal, is suitable 4:1 to 1:1, preferably about 3:1 to 1.5:1. The ratio of water-to-dry coal at conditions is below about 0.5:1 and the inlet ratio of water-to-dry coal is below about 1:1.

Preferred organic solvents include process-derived hydrocarbons suitable for ultimate use in the liquefaction stage. Exemplary solvents are 400° F.+ distillates up to and including VGO solvent and recycle liquefaction bottoms.

The pretreatment temperature has a large impact on the quality of coal. This effect may well be a consequence of the thermodynamics of the pretreatment reaction system that in general tends toward dehydrogenation at higher temperatures. A temperature within the range of 550° to 700° F. is suitable. Within that range, a range of about 550° to 650° F. is most preferred.

At a CO treat rate of 40%, as the temperature during the pretreatment stage is increased above a certain temperature (about 600° F.), the reactivity of the coal during subsequent liquefaction begins to decrease. On the other hand, as the temperature is decreased below a certain temperature, the improvement in coal properties attributable to pretreatment begins to diminish. A catalyst/promoter will allow the pretreatment reaction to proceed at a satisfactory rate a relatively lower temperature. However, below 550° F., uncatalyzed/unpromoted pretreatment reactions are too slow.

Although higher temperatures speed up the desired pretreatment reactions, lower temperatures prevent undesirable or retrogressive reactions. Therefore, to some extent, the reaction temperature selected is a compromise between competing effects.

An alternative embodiment is to temperature stage the pretreatment reactions by initially maintaining the temperature in the above mentioned 550° to 650° F. range for part of the time and then increasing the temperature to a range between 650° to 800° F.

The desired volatile matter content of pretreated coal can be obtained by maintaining the pretreatment temperature below about 650° F. Volatile matter is thought to be of particular importance in determining how well a particular coal will react in coal liquefaction. Concurrent measurements of other affected properties, such as coal oxygen content reduction and solubility, generally increase with increasing temperature.

Another important pretreatment process condition is carbon monoxide (CO) pressure. Higher CO pressures probably directly impact the formate ion concentration in the reaction system by shifting the reaction equilibrium to to the right as follows:

$$CO + H_2O \rightleftharpoons H^+ + HCOO^-$$

There is generally an increasing improvement in coal properties with increasing CO partial pressure ($P_{co}$). A suitable range is 500 to 1500 psi (initial) at ambient temperature, preferably about 850 to 1000 psi.

The total pressure at conditions (including $H_2O$ vapors, $CO_2$, $H_2$, CO, and $C_1$–$C_4$) is suitably in the range of about 1800 to 4500 psi, preferably about 2800 to 3400 psi, depending on Pco and the temperature, which in turn determines the water partial pressure ($P_{H2O}$).

As mentioned above, one of the most important coal properties for predicting the reactivity of coal in liquefaction is the volatile matter content. The partial pressure of CO in the pretreatment stage has a very important effect on the volatile matter content of coal generated during the pretreatment (volatile matter is taken as the sum of the volatile content of the residue recovered after pretreatment with carbon monoxide and the converted material during the pre treatment itself, including $CO_2$, chemical $H_2O$ and other light oxygenated species such as phenols, alcohols, organic acids and the like).

Generally, coal quality improves with increasing residence time in the pretreatment zone. A suitable residence time at 600° F. ranges from about 10 minutes to 5 hours, preferably, from an economic standpoint, 20 minutes to 2 hours, most preferably about 80 minutes.

Efficient mixing and good contact between the CO and coal in the pretreatment reactor is desirable. This can be accomplished with a mechanical stirrer and/or with stationary baffles that create high turbulence, or properly designed inlet gas sparges that produced small gas bubbles.

Particularly when employing an aqueous solvent during pretreatment, recycle of the aqueous phase to the pretreatment reactor is an optional feature which can provide certain advantages. Recycle may aid in dissolution of the coal as a result of the alcohols, phenols, and carboxylic acids contained in the recycle solution. Additionally, much of the calcium and sodium based on mineral components of the coal are dissolved in the aqueous solvent during the pretreatment step. Separate tests showing that these compounds accelerate the desired chemistry, are explained more fully below. A recycle rate of 3:1 to 10:1 is suitable (ratio of recycle to makeup water).

It has been found that certain chemical compounds act as promotors to significantly increase the hydrogen to carbon (H/C) ratio and volatile matter (VM) content of pretreated coals. (Previous experience has shown that coals with higher VM and H/C yield higher coal liquefaction reactivity.) Additionally, these compounds can be effective in generating a product coal with enhanced solubility in a typical solvent, for example tetrahydrofuran (THF). The increase in H/C and VM content results in improved reactivity and selectivity during subsequent liquefaction. The increase in solubility is beneficial in enhancing the separation of the pretreated coal into an ash-free component (soluble) and an ash enriched component (insoluble) by extraction, in the case where the pretreated coal is extracted prior to hydroconversion. It is also beneficial in promoting good contact with the solvent and coal during the conversion step. For a particular integrated process, it is possible to choose a promoter that can achieve the most desired result in the product coal (i.e., high H/C, high solubility or both) under the particular circumstances.(e.g., $H_3PO_4$, an acid catalyst with no hydrogenation activity, yields a product with good solubility but with very poor H/C and volatile matter content).

Suitable promotor compounds include, but are not limited to, sodium or calcium formate, acetic acid, sulfuric acid, sulfurous acid, carbon disulfide, hydrogen sulfide, sodium hydroxide, sodium carbonate, sodium bicarbonate, calcium iodide, formic acid, calcium hydroxide, calcium acetate, calcium oxide, sodium sulfite, ammonium sulfide, ammonium bisulfide, hydrogen sulfide and the like.

According to the proposed chemistry of the pretreatment stage, explained more fully above, it is believed that an important active intermediate is the formate anion generated by the reaction of CO and $H_2O$. Metal ions such as calcium, magnesium, sodium, lithium or potassium are believed to stabilize this formate anion by forming a formate salt. By increasing the concentration of formate ion in the system, more formic acid is also generated which will interact with the coal as desired.

Formic acid and formate anion are believed to donate hydrogen via an hydride ion to the coal material.

The acidic promotors such as acetic acid are believed to promote the reaction chemistry by making available soluble metal ions from the coal. Such aciss are believed to ion exchange with metals such as calcium in the coal matrix and form an equilibrium with calcium salts in solution. Such salts in turn ion-exchange with formic acid, which is thereby stabilized with metal cations to form a formate salt.

In view of the above, either acids or soluble metal salts of acids or bases can act as promotors. The most preferred promotors are ammonium salts and metal salts wherein the metal is in Group IA, Group IIA, or Group IIB of the Periodic Table, for example sodium or calcium formate and ammonium sulfide, $(NH_4)_2S$, or bisulfide, $(NH_4HS)$. Calcium or sodium hydroxide or oxides are also preferred. Other compounds may be preferred in certain process applications, for example CaO is low in cost and acetic acid is easily recovered. Process derived salts of acids and acids from coal have the advantage that at steady state they are potentially cost free. For example, calcium and sodium salts of acetic acid, formic acid, propionic acid, lactic acid and the like are made during the coal pretreatment and, when employing an aqueous solvent during pretreatment, may be concentrated or accumulated in a water recycle stream to the pretreatment zone. Such salts will be soluble and concentrated in such a pretreatment water recycle stream.

When an organic solvent is employed in the pretreatment zone, the promoters are suitably sprayed (in aqueous solution) onto crushed and/or hot oil grinded coal particles prior to entering the pretreatment zone.

The promotors should be present in the pretreatment reaction system in the amount by weight of 0.5 to 50%, preferably 0.5 to 10%, and most preferably 1 to 5%. However, certain low cost promotors, for example, ammonium bisulfide, ammonium sulfide or hydrogen sulfide, may be added in much higher amounts, for example about 50 wt %. Following coal pretreatment, the coal is sent to a hydroconversion or liquefaction zone. The liquefaction zone is where the coal is reacted with molecular hydrogen in the presence of a catalyst. The purpose is to generate a high yield of liquid products or coal oil.

Optionally, following pretreatment, the pretreated coal may be extracted with an organic solvent and, after a liquid-solid separation, only the solvent soluble portion of the coal sent to the hydroconversion zone. Such an embodiment is disclosed in greater detail in co-assigned and concurrently filed U.S. patent application Nos. 07/455,652 and 07,455,654, both filed Dec. 21, 1989 hereby incorporated by reference. Extraction of the coal may occur either in a separate extraction zone or, particularly when employing an organic solvent during pretreatment, in-situ in the pretreatment zone.

Following pretreatment, the coal is subjected to liquefaction wherein the coal is reacted with molecular hydrogen in the presence of a catalyst. The purpose is to generate a high yield of liquid products or coal oil.

Solvents employed in the hydroconversion (liquefaction) stage of the present invention may contain anywhere from ½ to about 2 weight percent donatable hydrogen, based on the weight of the total solvent. Preferred solvents include coal derived liquids such as coal vacuum gas oils (VGO) or mixtures thereof, for example, a mixture of compounds having an atmospheric boiling point ranging from about 350° F. to about 1050° F., more preferably ranging from about 650° F. to less than about 1000° F. Other suitable solvents include aromatic compounds such as alkylbenzenes, alkylnaphthalenes, alkylated polycyclic aromatics, heteroaromatics, unhydrogenated or hydrogenated creosote oil, tetralin, intermediate product streams from catalytic cracking of petroleum feedstocks, shale oil, etc. and mixtures thereof.

Conventional fixed bed catalysts are suitable when the pretreated coal is first extracted and only the ash free liquid extract sent to the hydroconversion zone. Preferably, the catalyst employed in the liquefaction stage is comprised of well-dispersed, submicron size particles. The catalyst may be a hydrocarbonaceous supported metal compound. Most preferably, the catalyst is formed from a precursor which is an organic oil-soluble metal compound. The precursor is typically added to the solvent so as to form a mixture of oil soluble metal compound, solvent and coal in a mixing zone. The oil-soluble metal containing compound make-up (not including additional amounts from recycle) is added in an amount sufficient to provide from about 10 to less than 5000 wppm, preferably from about 25 to 950 wppm, more preferably, from about 50 to 700 wppm, most preferably from about 50 to 400 wppm, of the oil-soluble metal compound, calculated as the elemental metal, based on the weight of coal in the mixture. Catalyst make-up rates are suitable from about 30 ppm to 500 ppm on coal. The remainder will normally be supplied from recycling the unconverted coal or bottoms, which contain active catalyst.

Suitable oil-soluble metal compounds convertible to active catalysts under process conditions include: (1) inorganic metal compounds such as halides, oxyhalides, hydrated oxides, heteropoly acids (e.g., phosphomolybdic acid, molybdosilicic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans, xanthic acid; phenols, di- and polyhydroxy aromatic compounds; (3) organometallic compounds such as metal chelates (e.g., with a 1,3-diketone, ethylene diamine, ethylene diamine tetraacetic acid, etc.); and (4) metal salts of organic amines such as aliphatic amines, aromatic amines, and quaternary ammonium compounds.

The metal constituent of the oil-soluble metal compound is selected from the group consisting of Groups VA, VIA, VIIA and VIIIA of the Periodic Table of Elements, and mixtures thereof, in accordance with the Table published by Sargent-Welch Scientific Company, copyright 1980, that is, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the oil soluble metal compound is selected from the group consisting of molybdenum, vanadium and chromium. More preferably, the metal constituent of the oil soluble metal compound is selected from the group consisting of molybdenum and chromium. Most preferably, the metal constituent of the oil soluble metal compound is molybdenum. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organic amine salts. More preferred types of metal compounds are the heteropolyacids, e.g., phosphomolybdic acid (PMA). Another preferred metal compound is a salt of an alicyclic aliphatic carboxylic acid such as a metal naphthenate. Preferred compounds are molybdenum naphthenate, vanadium naphthenate, chromium naphthenate, and molybdenum or nickel-dibutyl dithiocarbamates.

The preferred catalyst particles, containing a metal sulfide in a carbonaceous matrix formed within the process, are uniformly dispersed throughout the feed. Because of their small size, there are typically several orders of magnitude more of these catalyst particles per cubic centimeter of oil than is possible in an expanded or fixed bed of conventional catalyst particles. The high degree of catalyst dispersion and ready access to active catalyst sites affords good reactivity control of the reactions.

Since the catalyst is effective in weight parts per million quantities of metal on feed, it is economically feasible to use them on a once through basis, although some recycle is preferred.

Various methods can be used to convert a catalyst precursor, in the coal-solvent slurry, to an active catalyst. It is usually better to form the catalyst in-situ in order to obtain better dispersion. One method of forming the catalyst from the precursor or oil-soluble metal compound is to heat in a premixing unit prior to the liquefaction reaction, the mixture of metal compound, coal and solvent to a temperature ranging from about 615° F. to about 820° F. and at a pressure ranging from about 500 to about 5000 psig, in the presence of a hydrogen-containing gas. If the precursor does not have sulfur, a sulfur containing reagent such as $H_2S$, $CS_2$ (liquid), or elemental sulfur may be introduced. The hydrogen-containing gas may be pure hydrogen but will generally be a hydrogen stream containing some other gaseous contaminants, for example, the hydrogen-containing effluent produced in a reforming process.

If $H_2S$ is employed as the source of sulfur to activate the catalyst, the hydrogen sulfide may suitably comprise from about ½ to about 10 mole percent of the hydrogen-containing gas mixture. Hydrogen sulfide may be mixed with hydrogen gas in an inlet pipe and heated up to reaction temperature in a preheater or may be part of the recycle gas stream. High sulfur coals may not require an additional source of sulfur. The catalyst precursor treatment is suitably conducted for a period ranging from about 5 minutes to about 2 hours, preferably for a period ranging from about 10 minutes to about 1 hour, depending on the composition of the coal and the specific catalyst precursor used. Such a thermal treatment in the presence of hydrogen or in the presence of hydrogen and hydrogen sulfide converts the metal compound to the corresponding metal containing active catalyst which acts also as a coking inhibitor.

Another method of converting a catalyst precursor or oil-soluble metal compound to a catalyst for use in the present process is to react the mixture of metal compound, coal and solvent with a hydrogen-containing gas in the liquefaction zone itself at coal liquefaction conditions.

Although the oil-soluble metal compound (catalyst precursor) is preferably added to a solvent, and the catalyst formed in-situ within the slurry of coal and solvent, it is also possible to add already formed catalyst to the solvent, although as mentioned above, the dispersion may not be as good.

In any case, a mixture of catalyst, solvent, and coal occurs in the coal liquefaction zone which will now be described. The coal liquefaction zone is maintained at a temperature ranging from about 650° to 950° F., preferably from about 650° to 850° F., more preferably between about 750° and 800° F., and a hydrogen partial pressure ranging from about 500 psig to about 5000 psig, preferably from about 1200 to about 3000 psig. The space velocity, defined as the volume of the coal and solvent feedstock per hour per volume of reactor (V/H/V), may vary widely depending on the desired conversion level. Suitable space velocities may range broadly from about 0.1 to 10 volume feed per hour per volume of reactor, preferably from about 0.25 to 6 V/H/V, more preferably from about 0.5 to 2 V/H/V.

With bottoms recycle, a suitable solvent:coal:bottoms ratio by weight to the liquefaction zone will be within the range of about 2.5:1:0 to about 0.6:1:2. Reducing the solvent to solids ratio improves the thermal efficiency of the process because the reactor size is reduced for a given coal throughput, or allows for more throughput. Also when a heavier solvent is recycled at a lower solvent to solids ratio, less heat energy is required because less solvent is distilled during subsequent fractionation. A typical process solvent boiling range is from 450° to 650° F. IBP to about 1000° F. FBP.

The range of process conditions recommended for the liquefaction stage, according to an embodiment considered the best mode, is summarized in Table 1 below:

TABLE 1

| Variable | Broad Range | Preferred Range |
|---|---|---|
| Liquefaction Temperature, °F. | 650-950 | 650-800 |
| Pressure, psig | 1500-3000 | 2500-3000 |
| Slurry, Residence Time, Min | 25-480 | 60-240 |
| Solvent/Coal Ratio, by wt | 0.6-2.5 | 0.8-1.2 |
| Bottoms/Coal Ratio, by wt | 0-2 | 0.5-1.5 |
| $H_2$ treat, wt % on coal | 4-12 | 5-9 |
| Sulfur on Coal, wt % | 0-10 | 0-4 |
| Solvent Boiling Range, °F. | 450-1000 | 650-1000 |
| Catalyst Metal on coal, wppm | 100-5000 | 300-1000 |

An alternate embodiment of the liquefaction zone comprises a plurality of liquefaction reactors for staged conversion. A first coal conversion reactor, wherein the catalyst loading is on the order of about 1000 ppm is followed by a second reactor, to which heavy VGO is sent, and where the catalyst loading is on the order of about 10 percent. Heavy catalyst loadings can provide a nearly finished product, eliminating the need for later expensive hydrotreating.

The process of the invention may be conducted either as a batch or as a continuous type process. Suitably, there are on-site upgrading units to obtain finished products, for example transportation fuels. DESCRIPTION OF THE DRAWINGS. Referring now to the embodiment of FIG. 1, pulverized coal is introduced by line 1 into a mixing and pretreatment zone 3 wherein the coal is mixed with water and carbon monoxide introduced by lines 5 and 6, respectively. A promoter is introduced into the pretreatment zone in any of several ways. A promoter can be mixed with the water in stream 5, sprayed on the coal, separately introduced into the pretreatment zone, or in the case of certain promoters, accumulated as a by-product of the coal in the recycle stream 13. This coal mixture is subjected to elevated temperature and pressure conditions as described heretofore. The gases remaining or produced in the pretreatment zone, typically $CO_2$, CO, $H_2O$, $H_2$ and $C_1$-$C_4$ hydrocarbons, are removed via line 15.

Following pretreatment, the coal can be suitably dewatered in a conventional slurry or settler dewatering system, followed by a standard gravity filter belt press or the like which squeezes bulk water from the coal material. Water is shown removed from the pretreatment zone in FIG. 1 by line 13. Typically, the water content of the coal mixture is reduced to the equilibrium moisture content of 8 to 10% plus free water of about 10%. Most of the remaining water can be removed in a slurry drier 4, wherein the coal material with absorbed moisture is mixed with hot solvent. Typically, the coal is dried to about 0.5 wt % before liquefaction. On the other hand, the coal which is sent via line 14 to the partial oxidation unit, described below, is typically sent directly from the filter press, without further drying.

Figure 2:
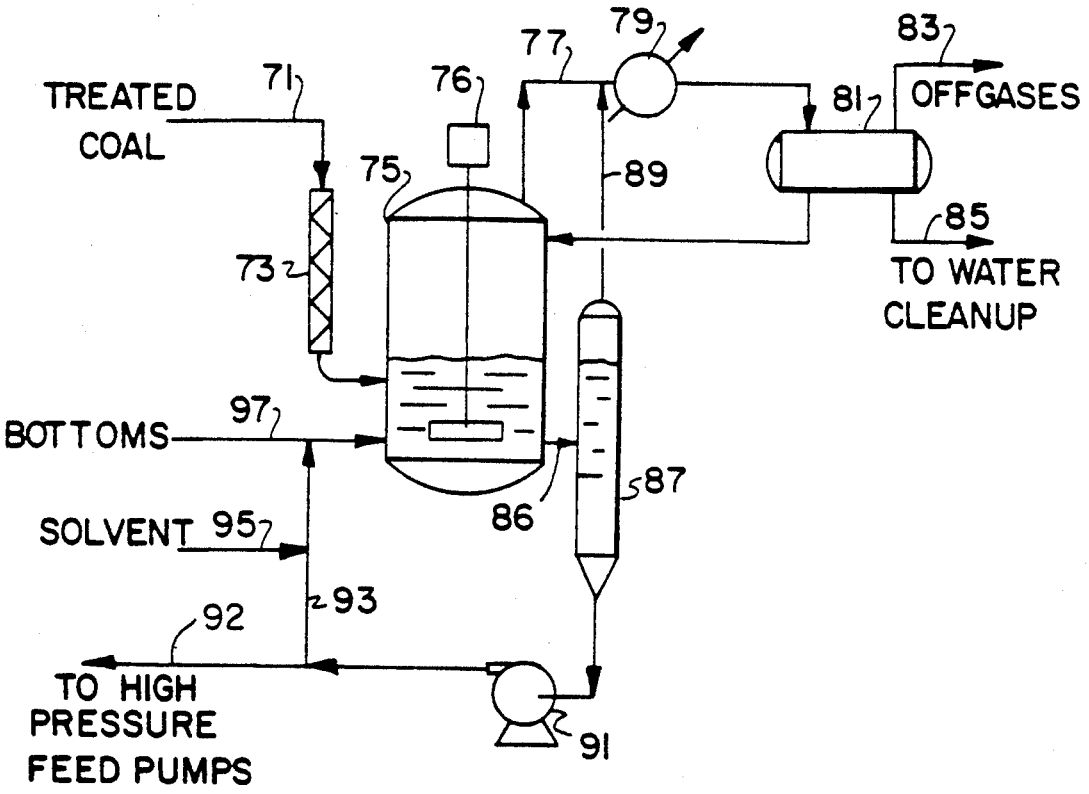
FIG. 2 shows a process flow diagram illustrating a means for dewatering of the coal mixture formed during pretreatment.

FIG. 2 illustrates a slurry dewatering system. The pretreated coal feed is introduced via line 71 through screw feeder 73 for introducing the pretreated coal into slurry drier 75. A mixer 76 gently mixes the coal mixture while allowing off gases and water vapor to escape via overhead line 77. The overhead vapors are cooled in condenser 79 and water is accumulated in collector 81. The off gases in line 83 are treated in an environmentally acceptable manner to remove pollutants. The water stream 85 is sent for cleanup and recycle to the pretreatment zone and/or purge. The bottoms from slurry drier 75 are removed via line 86 and passed to a vessel 87 where they are collected, while allowing further escape of off gases and water vapor via line 89. The dewatered and degassed coal is then sent via pump 91 to high pressure feed pumps for further processing. A portion of the coal leaving the slurry drier may be recycled via line 93, and make-up solvent is optionally introduced via line 95. The dewatered coal in line 92 may be sent to a filter press for further dewatering. Additional bottoms from downstream may be introduced via line 97.

Water which is recycled from dewatering operations may optionally be partially purged of organic contaminants. For example, the hydrocarbon content may readily approach 2 to 5% weight on daf coal feed to the pretreatment zone. A certain amount of recycle water may be pulled off as blow down, thereby limiting the amount of certain organic compounds which build-up, for example phenolic and carboxylic compounds.

Figure 3:
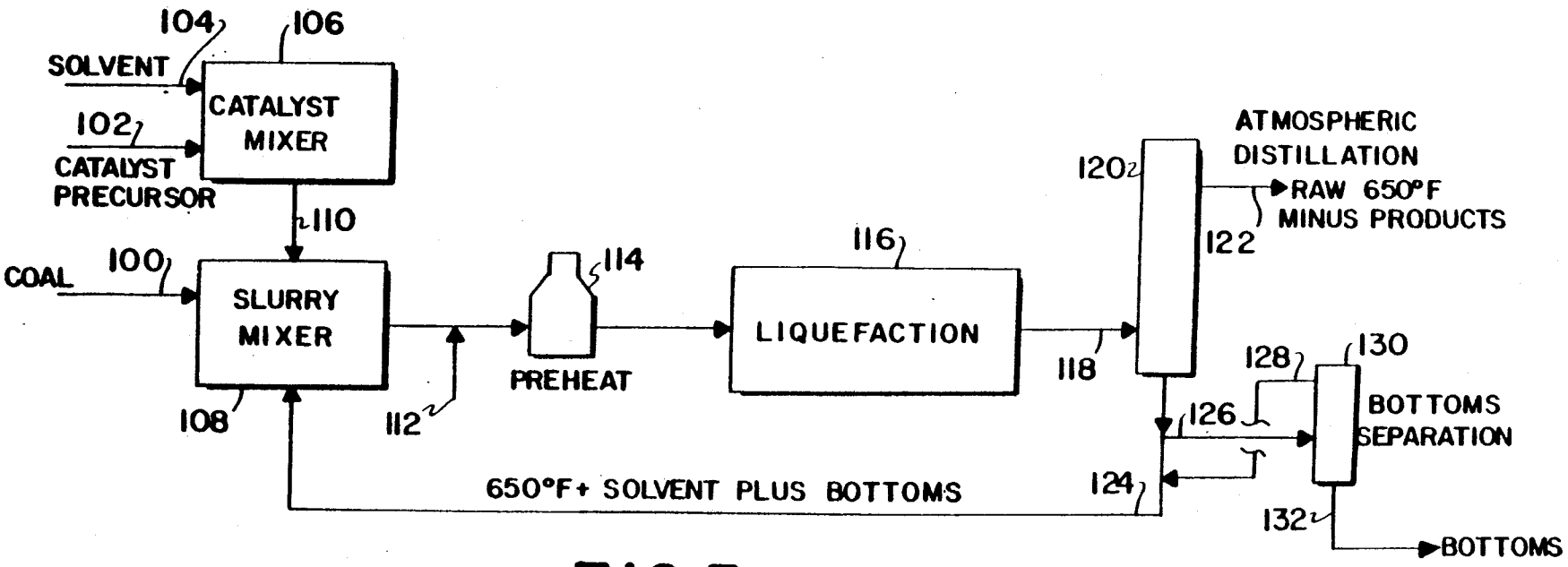
FIG. 3 shows a process flow diagram illustrating treatment of the liquid effluent of a liquefaction reactor.

Referring again to FIG. 1, following pretreatment and dewatering, the coal enters a mixing zone 17 (analogously in FIG. 3, the coal in line 100 enters the slurry mixer 108) wherein recycled solvent is added by line 19 (124 in FIG. 3) to the coal. Optionally, recycled bottoms and solvent from downstream can be introduced via line 21 (128 in FIG. 3). A catalyst precursor containing solvent is introduced into the mixing zone 17 via line 23. In FIG. 3, a solvent stream 104 and catalyst precursor 102 are introduced into a catalyst mixing zone 106. The components in the mixing zone are intimately mixed to form a homogenous slurry.

The mixture of oil-soluble metal catalyst precursor, solvent, and coal is introduced into preheating zone 114 as shown in FIG. 3. A gaseous mixture comprising hydrogen, and optionally, hydrogen sulfide, is introduced via line 112. The preheating zone is suitably maintained at temperatures ranging from about 600°-700° F. and pressures of about 2000-2500 psi.

The coal and catalyst slurry is then introduced into a liquefaction zone 29 (or 116 in FIG. 3). The liquefaction reactor may be any suitable vessel or reactor capable of withstanding the desired temperature and pressure liquefaction conditions. Typically, there are a plurality of staged liquefaction reactors (not shown), the conditions of each reaction zone being set to maximize desired equilibrium limits and kinetic rates and to obtain the best profile of products.

A hydrogen-containing gas may be introduced directly into the liquefaction reactor 29 via line 31 for temperature control purposes. The hydrogen-containing gas may be pure hydrogen, but will generally be a hydrogen stream containing some other gaseous contaminants, for example, the hydrogen recycle gas. Suitable hydrogen-containing gas mixtures for introduction into the liquefaction zone include raw synthesis gas, that is, a gas containing hydrogen and from about 5 to about 50, preferably from about 10 to 30 mole percent carbon monoxide. Another suitable hydrogen containing gas is obtainable from the steam reforming of natural gas. Pure hydrogen if available is also suitable.

Preferably, hydrogen is provided by a partial oxidation unit 33. In that process, molten coal bottoms are pumped into a partial oxidation reactor, essentially a gasifier, in the form of small droplets, where it is mixed with oxygen (for example, from an oxygen plant) and stream. The amount of oxygen is adjusted so that oxidation of the coal material all the way to $CO_2$ does not occur. Instead, the following reactions occur:

$$2C+O_2 \rightarrow 2CO$$

$$C+H_2O \rightarrow CO+H_2$$

The mixture of CO and $H_2$ produced, known as "synthesis gas", can be sent to a separation device, for example a PRISM membrane unit 41 (registered trademark of Monsanto Corporation) following acid gas removal in separator 35 where $H_2$ is removed as a by-product via line 43 and the CO in line 6 is used for the pretreatment step. In addition, some of the gases from the partial oxidation unit can be passed over a Ni catalyst and contacted with additional water in reactor 39 to produce $CO_2$ and $H_2$ according to the following water gas shift reaction:

$$CO+H_2O \rightleftharpoons CO_2+H_2$$

Following acid gas removal in separator 37, $H_2$ is obtained in line 47. The hydrogen in lines 43 and 47 can be used in the liquefaction reaction zone.

It is noted in FIG. 1 that there are two partial oxidation units. The first (shown on the left and labeled coal POX) may be referred to as "slurry partial oxidation", wherein the coal is basically in solid form. The second (shown on the right and labeled VB POX) may be referred to as "molten liquid vacuum bottoms partial oxidation". Typically the weight ratio between the feeds to the first and second partial oxidation units is 50 to 35. Advantageously, the slurry partial oxidation unit, according to the present integrated process, operates on coal having a reduced equilibrium moisture content due to the coal dewatering and deoxygenating effect of the pretreatment stage. For example, instead of 50 weight percent solids characteristic of low rank coal feeds, it is possible to have about 60 percent weight solids in the feed to the slurry partial oxidation unit, preferably about 65 percent. (Of course, to some extent this advantage must be balanced against investment costs, operating costs, and waste water treating costs of the pretreatment unit). The biggest benefit will be for lower rank coals. Since there is less water for a given amount of coal in the partial oxidation reactor, significantly less coal is required to provide the heat (about 2500° F.) required for gasification (water consumes much energy due to its high latent heat of vaporization) and the coal can be slurried at a higher solids concentration for partial oxidation, thereby increasing the thermal efficiency. Accordingly, improving the efficiency of moisture removal from low rank coals can have a significant impact on the overall economics of processing the coal.

Returning to the liquefaction zone 29 in FIG. 1, the effluent in line 49 comprises gases, an oil product and a solid residue. The effluent is passed to a separation zone 51 (including an atmospheric pipe-still) from which gases are removed overhead by line 53. The gases typically comprise $C_1$-$C_4$ hydrocarbons, $H_2$, and acid gases. The $C_1$-$C_4$ gases may be used as fuel, for example to preheat the coal. The $H_2$ may be recycled to the coal liquefaction zone via line 31 or used for upgrading the liquid products. The gases may be first scrubbed by conventional methods to remove any undesired amounts of hydrogen sulfide and carbon dioxide.

The solids component of the liquefaction effluent may be separated from the oil product by conventional means, for example, by settling, centrifuging or filtration of the oil-solids slurry. Preferably a fractionator or vacuum separator 59 is utilized to separate solvent and bottoms in line 55. If desired, at least a portion of the separated solids or solids concentrate may be recycled directly to the coal liquefaction zone or recycled to the coal-solvent chargestock via line 21. The remaining portion of solids may be discarded in an environmentally acceptable manner or combusted for producing steam. However, it is advantageous to send it as raw material to the partial oxidation unit 33, where it can be used to produce $H_2$ for lines 43 and 47, as described above and CO for the pretreatment step via line 6.

The hydrocarbonaceous oil produced in the liquefaction zone is removed from separation zone 51 by line 57 and passed to fractionation zone 61 wherein various boiling range fractions can be obtained, for example a heavy fraction, an intermediate fraction, and a light fraction. These fractions may be sent to an upgrading zone 63, where treatment with hydrogen in line 65, optionally in the presence of a hydrotreating catalyst, yields final products in line 67. In a preferred embodiment of the present invention, at least a portion of the oil product, which includes the recovered solvent, is recycled via vacuum separator 59 and line 19, into mixing zone 17 or directly into the coal liquefaction zone 29.

Various process options for treating the liquid effluent which is removed from the coal liquefaction reactor 29 are possible and will be recognized by those skilled in the art.

For example, referring to FIG. 3, a preferred embodiment is shown for treating the liquid products. The liquid effluent 118 from liquefaction reactor 116 is fractionated in an atmospheric fractionator 120 into raw 650° F.− products in line 122. A portion of the atmospheric bottoms is recycled in recycle stream 124 in the desired ratio with coal and catalyst. The atmospheric bottoms not required for recycle to liquefaction are routed in line 126 to a bottoms separator 130 to recover additional 650° F.+ liquids in line 128 for use as solvent. This separator 130 may be a vacuum distillation tower, solvent extraction unit, etc. The residual vacuum bottoms in line 132 can be utilized as feed, separately or blended with coal, to a partial oxidation unit, a hybrid boiler, or a conventional boiler for process heat or hydrogen.

The recycle atmospheric bottoms stream contains active, well-dispersed microcatalyst. Makeup catalyst is needed to maintain catalyst concentration due to loss of catalyst purged with the bottoms.

In another embodiment, a fractionator following the coal liquefaction zone may be used to separate the effluent into a light liquid or naphtha, $C_5$ to 400° F. (400−), a distillate at 400°-650° F. and a solvent at 650°-1000° F. The solvent is preferably recycled to the liquefaction reactor and the bottoms from the fractionator can be recycled to the liquefaction reactor and/or purged.

The following examples illustrate certain preferred embodiments and advantages of the present process. The examples are not intended to limit the broad scope of the the present invention. Other advantages and embodiments of the present invention will be apparent to those skilled in the art from the description provided herein. For example, an organic solvent may be employed to disperse the coal particles during pretreatment, and/or the pretreated coal may be extracted and the solvent soluble portion, rather than the total coal material including ash, sent to the hydroconverion zone.

EXAMPLE 1

This example illustrates a combined pretreatment and liquefaction process with a lignite feed. Troup lignite (23% moisture) is reacted in $H_2O$/CO at 650° F. for 1 hour at a total pressure of 4400 psi. The total daf conversion is about 22%, including 12% $CO_x$ (mostly $CO_2$), 0.24% $C_1$-$C_3$ gas, 0.28% $H_2S$, and 9.5% water plus hydrocarbonaceous liquids (mostly water). As shown in Table 3 below, the oxygen and moisture contents are substantially decreased during the treatment, the H/C ratio is increased as hydrogen is transferred into the products from water, and 40% of the organics are converted to preasphaltenes. The properties of the pretreated coal are as follows:

TABLE 3

| Coal Properties | Pretreated Coal Properties | |
|---|---|---|
| | Raw Group | $H_2O$/CO Pretreated |
| H/C | 0.85 | 0.91 |
| O/C | 0.23 | 0.13 |
| Asphaltenes & Preasphaltenes, wt % DAF | 0.4 | 42.5 |
| Eq. Moisture (g $H_2O$/g dry coal) | 0.42 | 0.17 |

The solid product is then thermally dried and reacted under liquefaction conditions in once-through tubing bomb experiments for reaction times between 30 and 120 minutes. The conditions are 800° F., solvent/coal 1.6/1, 60%/40% decalin/tetralin solvent with DH 1.2, $H_2$ treat 6%, and 1000 ppm Mo as MoDTC (molybdenum dibutyl dithiocarbamate). The pretreated coal reacts more quickly in liquefaction than the raw coal. Although at 2 hours reaction time in liquefaction the pretreated coal only reaches a combined conversion about 3% higher than that of the raw coal, it requires <1 hour reaction time to reach this conversion. Consequently, one hour in $H_2O$/CO followed by one hour in liquefaction gives about 3% higher conversion but more importantly ~8% more liquids with 1% less hydrogen consumption than 2 hours in liquefaction alone. A large part of this difference is due to a reduction in the amount of $C_1$-$C_3$ gas produced during the shorter reaction time in liquefaction.

The described pretreatment step has been effective in increasing the reactivity and conversion of a range of feeds including peats, brown coals, lignites, sub-bituminous and bituminous coals. Advantages of the pretreatment step in combination with the disclosed liquefaction stage have also been demonstrated for Rawhide coal as shown in Table 4.

TABLE 4

| | Conversion of Rawhide Coal[a] | | |
|---|---|---|---|
| | | Liquefaction/800° F. 1000 ppm Mo 1 Hour[b] | |
| | Pretreatment | Pretreated | Raw |
| Wt % DAF Coal: | | | |
| Total Conversion | 20 | 60 | 50 |
| $CO_x$ | 12 | 14.2 | 15.1 |
| $C_1$-$C_3$ | 0.33 | 4.27 | 5.58 |
| $H_2S$ | 0 | 0.1 | 0.1 |
| Liquids + Water | 7.7 | 42.7 | 30.5 |
| H2 Consumption | — | −1.3 | −1.42 |

Notes:
[a]Rawhide, a sub-bituminous coal from Wyoming, is a potentially attractive synfuels feedstock because it is a low sulfur and ash, low cost coal which can be surface mined. Unfortunately, it is debited by its high moisture and oxygen levels. An aqueous CO pretreatment provides a route for efficiently reducing the oxygen and moisture contents while improving reactivity.
[b]1.6:1 aqueous solvent to coal with donor hydrogen level of 1.2%.

EXAMPLE 2

This example illustrates the effect and advantages of a carbon monoxide pretreatment over 3 control treatments, namely (1) none, (2) decalin and $N_2$, and (3) $H_2O$ and $N_2$. Rawhide coal with as-received moisture levels of 27-33% was stored under $N_2$ in sealed glass jars. Analysis of the raw coal is given in Table 5.

TABLE 5

| | Analysis of Rawhide Coal | | | | | | |
|---|---|---|---|---|---|---|---|
| MOISTURE (as received) Wt % | ASH Wt % Dry | VOLATILE MATTER | O | S | C | H | N |
| | | | Wt % daf Coal | | | | |
| 33 | 5.8 | 47.6 | 20.85 | 0.22 | 73.11 | 4.8 | 1.03 |

For the experiments, the coal was ground quickly in a mill to −30 mesh and resealed in glass jars to minimize moisture loss. Both raw and treated coal for the liquefaction experiments were dried overnight in a vacuum oven at 230° F. and ground to 30×100 mesh.

The pretreatments and the liquefaction experiments were performed in tubing bomb reactors in a fluidized sand bath. The reactors used for the pretreatment experiments were constructed from 1 inch 316 stainless steel pipe and had approximate volumes of 70 cc. These reactors could be operated at pressures as high as 4500 psi at temperatures up to 700° F. In the experiments, 6 g of wet Rawhide coal (moisture 27-33%) was charged into the reactor with 12 g of deoxygenated, deionized water or decalin, depending on the experiment. The reactors were connected to a gas manifold where they were purged and charged with CO or $N_2$. The pressure was measured by a pressure transducer. Six tubing bombs could be charged and reacted simultaneously.

The charged reactors were wired to a rack and submerged in a fluidized sand bath where they were agitated at a rate of 200 cycles per minute. They reached reaction temperature within 5 minutes. In order to assure that the temperature was uniform for all of the reactors, thermocouples were periodically attached to bombs at different points on the rack. Temperatures did not generally vary more than 2° F. between the bombs. As an added precaution, however, duplicate bombs were positioned at different levels on the rack to pick up any unexpected temperature gradients. At the end of the desired reaction period, the bombs were removed from the sand bath and allowed to cool in air for 10 minutes before being quenched in a water bath.

The gas from each cooled bomb was discharged through an empty glass gas displacement bomb (250 or 500 cc) into a water displacement system where the volume was measured. After about half of the gas had been discharged, the gas bomb was isolated and removed from the system. This was then submitted for GC analysis. Operating the system in this way prevented contact of the GC samples with the water in the gas displacement system. In addition, collecting the GC sample halfway through the gas discharge minimized the effects of selective diffusion of the lighter gases.

The bombs were then opened, and the water was decanted into a vial, taking care not to lose any solid material. The solids were washed into a 50 cc centrifuge tube with deionized water. The bombs were repeatedly scraped and washed with deionized wate until all of the solids were removed. The bombs were dried in a vacuum oven and reweighed. They were then washed with MEK to remove any residual solids, redried, and reweighed. Weight loss during the MEK wash was used to estimate unrecovered solids. This was generally below 0.1 g. The centrifuge tubes containing the recovered solids were centrifuged for 15 minutes. The water was decanted and filtered through a tared #2 filter to collect any particles floating on the water layer. The solids in the centrifuge tube and the filter paper were dried overnight in a vacuum oven at 230° F., and the dried solids from the filter paper (usually <0.05 g) were added to the solids in the centrifuge tube. These procedures allowed calculation of overall conversion and gas yields. Liquid and water products were then determined by difference.

To measure the THF (tetrahydrofuran) solubility of the treated coal, the dried solid products were finely ground and 1-2 g was weighed into a 50 cc centrifuge tube. The tube was filled with THF, stirred at room temperature for 2 minutes, and centrifuged for 10 minutes. The THF was then decanted and saved. This procedure was repeated 4 or 5 times, or until the decanted THF was clear. The solids (THF insolubles) were dried as before. To collect the THF solubles, the THF was weathered off under a N2 purge and the solids were dried in a vacuum oven.

The liquefaction experiments were performed in standard tubing bombs constructed of ¾" 316 stainless steel tubing having volumes of about 37 cc. The reactors were charged with 3.0 g of dried coal, 4.8 g of a 60/40 decalin/tetralin mixture (DH=1.2), and 0.017 g of MoDTC. This gave a Mo loading on dry coal of 1000 ppm. The bombs were charged with 1000 psi of $H_2$ and reacted in the fluidized sand bath at 800° F. The bombs were removed and cooled, and the gases were collected and measured as described earlier. The solids were scraped and washed from each bomb into centrifuge tubes using cyclohexane. The solids were then extracted with cyclohexane five times, using the procedure described earlier for THF. Total liquefaction conversion was calculated from the amount of cyclohexane insolubles (unconverted coal). Gas yields were calculated from the gas analyses, and liquid and water yields were determined by difference.

All tubing bomb experiments were run at least in duplicate. The data reported here represent the average of at least two bombs. For liquefaction experiments, each run included an untreated Rawhide coal base case.

The volume of each tubing bomb was measured by charging the bomb with 600 psi $H_2$ and measuring the volume of gas in the bomb using the water displacement system. Volume determinations were made in triplicate.

Wet Rawhide coal was pretreated in decalin/$N_2$, $H_2O/N_2$, and $H_2O$/CO for 2 hours at 650° F. with a gas charge of 900 psi (cold). Decalin was used as an inert solvent to slurry the coal in order to study its thermal reactions. Pressure at 650° C. was ~4400 psi for the aqueous systems, and ~2000 psi for the decalin system. Table 6 lists the conversions of the coals and compares the effects of the treatments on several important properties of the pretreated coals.

TABLE 6

Conversion of Rawhide Coal in Aqueous and Thermal Systems at 650° F.
Decalin/$N_2$ Pretreatment: Dried Coal, 650° F., 2000 psi, 2 Hours
Aqueous Pretreatments: Wet Coal (33% Moisture), 650° F., 4400 psi, 2 Hours

| | Pretreatment | | | |
|---|---|---|---|---|
| | None | Decalin/$N_2$ | $H_2O/N_2$ | $H_2O$/CO |
| Conversion (Wt % daf Coal) | | | | |
| $CO_x$ | — | ND* | 12 | 12 |
| $C_1$-$C_3$ | — | ND | 0.3 | 0.3 |
| Liquids + $H_2O$ | — | ND | 6.7 | 7.7 |
| Total Conversion | — | 6 | 19 | 20 |
| Properties Of Treated Coal (Wt % daf Coal) | | | | |
| THF Solubles | 6 | 4 | 8 | 65 |
| H/C Ratio | 0.80 | 0.72 | 0.73 | 0.91 |
| Oxygen | 20 | 16 | 13 | 11 |
| Sulfur | 0.2 | ND | 0.2 | 0.2 |
| Nitrogen | 1.0 | ND | 1.1 | 1.2 |
| Ash (% Dry) | 5.8 | ND | 6.0 | 6.0 |
| Moisture (% Coal) | 32 | ND | 12 | <9 |

*ND = not determined.

In both aqueous systems, 19–20% of the coal was converted to $CO_2$, $H_2O$, and liquids. In the thermal system, the conversion was only 6%. The aqueous CO pretreatment increased the solubility of the coal in THF from 6% to 65%. This is an indication that a significant amount of depolymerization of the coal structure occurs during the pretreatment. This pretreatment also increased the H/C ratio of the coal from 0.8 to 0.91. About 40% of this increase is due to loss of carbon as $CO_2$, so about 60% must be due to hydrogenation, with water as the ultimate source of hydrogen. A hydrogen balance indicates that about 0.8 wt % hydrogen (based on raw daf coal) was transferred from the water to the coal. No evidence of depolymerization or hydrogenation of the coal was noted after the decalin/$N_2$ or $H_2O/N_2$ pretreatments at the same conditions. In these runs, the THF solubilities of the coals did not increase and the H/C ratios were reduced to 0.72 and 0.73, respectively, most likely due to the removal of coal oxygen as $H_2O$.

The depolymerization and hydrogenation of the coal in aqueous CO enhances its reactivity for further hydroconversion or liquefaction processing. Conversely, the decrease in H/C ratio noted after the thermal and $H_2O/N_2$ pretreatments could debit liquefaction conversion.

None of the pretreatments significantly altered the ash, nitrogen, or sulfur contents of the coal. Although all of the pretreatments resulted in some loss of oxygen from the coal, the aqueous pretreatment chemistry significantly promoted oxygen removal. This was reflected both in $CO_2$ production during the pretreatment, and in the oxygen contents of the treated coals. Thermally, only 11% of the oxygen was removed, while in $H_2O/N_2$ and $H_2O$/CO, the oxygen content was reduced by 40% and 50%, respectively.

Physical and chemical changes which occur in the coal structure during the aqueous pretreatments cause the coal to lose its capacity to hold moisture. The equilibrium moisture content of the coal was reduced from 32% to 12% in the $H_2O/N_2$ pretreatment, and <9% in the $H_2O$/CO pretreatment.

These results show the advantages of the aqueous CO pretreatment over the thermal and $H_2O/N_2$ pretreatments at the same conditions. The aqueous CO pretreatment not only provides the highest degree of dewatering and deoxygenation, but also improves the properties of the coal which control its reactivity in further processing. The other pretreatments degrade these properties.

EXAMPLE 3

Figure 4:
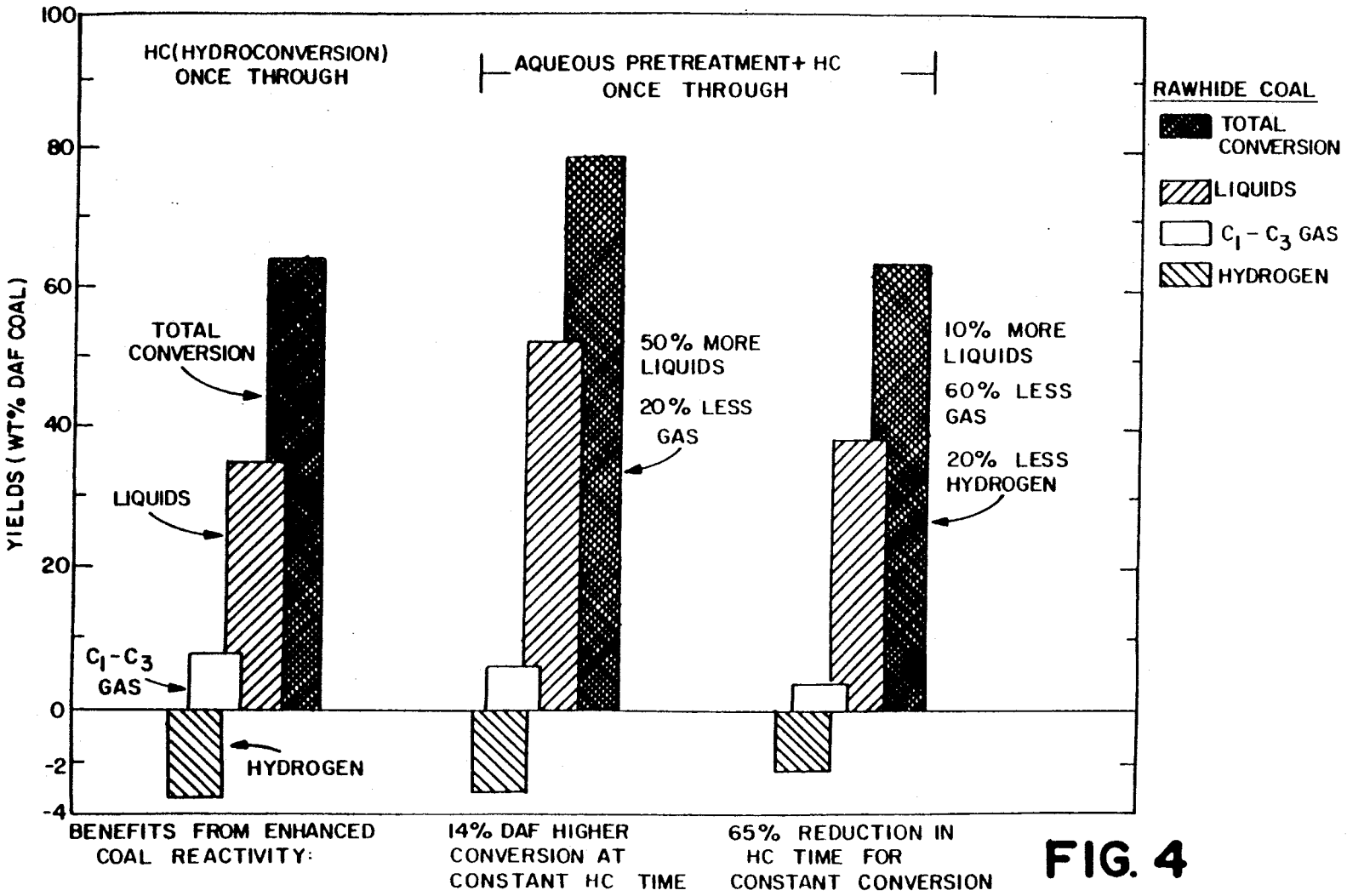
FIG. 4 is a chart showing the effect of the pretreatment of coal in improving the liquefaction product selectivity and conversion.

This example illustrates the effect of pretreatment conditions on both conversion in and on the properties of the pretreated coal. Wet Rawhide coal was reacted in aqueous CO for 2 hours with a CO charge of 900 psi (cold) at temperatures between 450° and 650° F. Because the vapor pressure of water increases almost exponentially in this temperature range, small changes in temperature can significantly impact the pressure of the system. FIG. 4 shows the properties of the treated coals including H/C ratio, oxygen content, volatile matter, and equilibrium moisture.

Various properties and conversions respond differently to the aqueous CO treatment temperature. There is evidence of hydrogen transfer into the coal from the water at temperatures as low as 450° F. The production of THF solubles takes off at temperatures above about 550° F. Equilibrium moisture drops significantly at temperatures as low as 450° F. Oxygen content shows a slower decline with temperature. Conversion and properties appear to line out somewhat about 625° F.

The effect of CO pressure on conversion and coal properties in the aqueous CO system at 625° F. was studied. CO pressure was changed by varying the initial CO charge between 700 and 900 psi at room temperature. The measured pressure at reaction temperature varied from 3300 to 3900 psi. Over this range of pressures, essentially no changes were detected in the total conversions to liquids+water+gas, or in the oxygen contents or H/C ratios of the treated coals. A slight increase in volatile matter was noted, but the largest variation was in the production of THF solubles which ranged from 35% to 47% over this set of conditions. The data at the lowest pressure of 3300 psi still displayed substantial improvements in all of the coal properties tested.

Reaction times between 30 minutes and 4 hours were studied in the aqueous CO system at 625° F./3300 psi and 650° F./4400 psi in order to show the effect on conversions and coal properties. At both temperatures, conversions to liquids+water+gas showed only minor changes over this range of times, while production of THF solubles was very dependent on reaction time. For the 625° F. cases, the rate of production of THF solubles appears to increase between 1 and 2 hours, and then slow somewhat between 2 and 4 hours. Between 2 and 4 hours the yield of THF solubles still increases significantly, from 38% to 57%. At 650° F. the rate of production of THF solubles is already decreasing between 1 and 2 hours, and between 2 and 4 hours only a small increase in THF solubles is observed. At 650° F. the oxygen content of the treated coal shows only small further decreases after 1 hour in aqueous CO, while at 625° F. it is somewhat slower in leveling off. At both temperatures, volatile matter and H/C ratio are more dependent on reaction time.

The effect of the $H_2O$/coal and CO/coal ratios on conversions and coal properties were also studied over a range of temperatures. All of the data discussed earlier were obtained at $H_2O$/daf coal weight ratios of 3.3–3.7 and at CO/daf coal weight ratios of 0.65 (700 psi CO charge) and 0.84 (900 psi CO charge). These CO/daf coal weight ratios are equivalent on a molar basis to hydrogen treats of 4.6% and 6%, respectively. The $H_2O$/coal and CO/coal ratios were varied by changing the amounts of wet coal and water charged to the reactors in order to show the effects on conversion to THF solubles and on the H/C ratios of the treated coals to temperatures of 550°, 600°, and 650° F., all at 2 hour reaction times.

EXAMPLE 4

This example illustrates the effect of pretreatment on increasing the reactivity of coals in liquefaction. Rawhide coal was pretreated in aqueous CO for two hours at 650° F. and 4400 psi and then reacted in liquefaction at 800° F. for 0.5–4 hours. The results are compared to data for conversion of non-pretreated Rawhide coal in FIG. 5. For the case which includes the aqueous CO pretreatment, yields are the combined yields in the aqueous and liquefaction stages, total reaction time includes the 2 hours in the aqueous stage, and the hydrogen consumption includes the CO (on a molar equivalent basis) consumed in the aqueous stage. After the aqueous CO pretreatment, Rawhide coal not only reacts more quickly in the liquefaction step, but also reaches a 15 daf wt % higher conversion at long liquefaction reaction times. The increased conversion appears as liquids. Even at the highest conversion, $C_1$–$C_3$ gas yields and hydrogen consumption are reduced compared to the non-pretreated coal.

Figure 5:
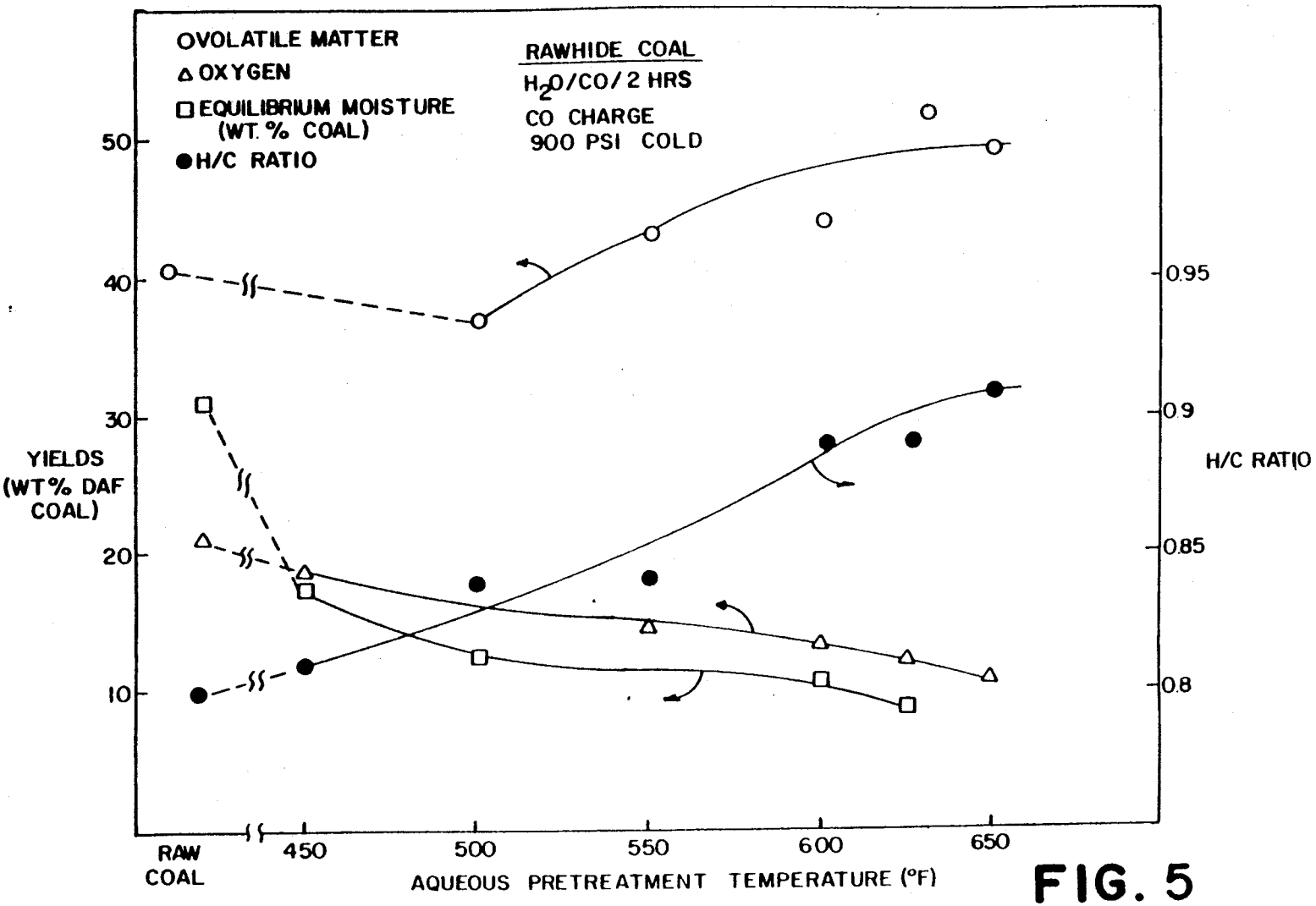
FIG. 5 is a graph showing the effect of coal pretreatment temperature on the properties of coal.
Figure 6:
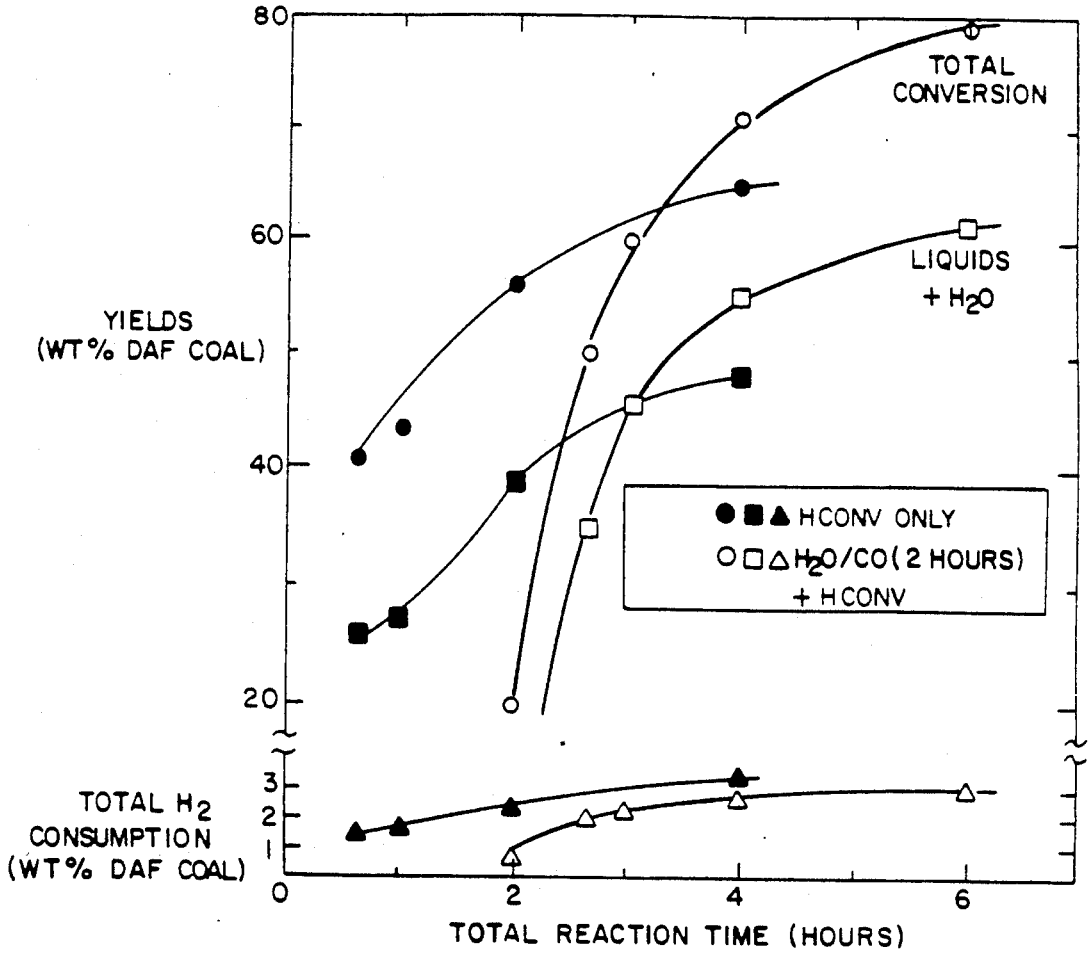
FIG. 6 is a graph showing the effect of coal pretreatment according to the present invention on liquefaction reactivity of coal.

There are several ways to take advantage of the enhanced reactivity of the aqueous CO pretreated Rawhide coal in liquefaction. To illustrate this, some of the data from FIG. 5 are replotted as bar charts in FIG. 6. If the pretreated and non-pretreated coals are reacted for equal amounts of time in liquefaction (10 (a) and (b)), the coal can reach a 14 daf wt % higher conversion in the combined aqueous pretreatment/liquefaction process than in liquefaction alone. This results in a 50% increase in liquid yields, while the $C_1$–$C_3$ gas make is reduced by about 20% (both on a relative basis). Even with this large increase in liquid yields, the total hydrogen consumption is slightly reduced, which indicates that the hydrogen utilization efficiency has been markedly improved.

The enhanced reactivity of the aqueous pretreated coal can also be used to improve product selectivity at constant conversion. The liquefaction reaction time for the pretreated coal can be decreased so that it reaches the same total conversion as the nonpretreated coal (10 (a) and (c)). After the aqueous pretreatment, only 35% as much reaction time in liquefaction is required for the pretreated coal to reach that conversion. Since the pretreated coal has been exposed to the more severe liquefaction conditions for a much shorter time, the $C_1$–$C_3$ gas make is reduced by 60%. This increases the liquid yield by 10%. Since lower H/C liquid products are being substituted for higher H/C gas products, the total hydrogen consumption is reduced by 20%. (All %'s are again expressed on a relative basis.)

EXAMPLE 5

This example illustrates the response of pretreated Rawhide coal to liquefaction conditions. In one set of runs, the hydrogen pressure (and consequently hydrogen treat) was increased. As shown in Table 7 below, the conversions of both the untreated and aqueous CO pretreated Rawhide were increased by 6–6.5%, preserving the conversion difference between the two cases.

TABLE 7

Effect of Hydrogen Treat and Pressure on Liquefaction (L) Conversions of Untreated and Aqueous CO Pretreated Rawhide

| Conversion | $H_2$ 1000 psi (cold) ($H_2$ Treat 6 wt %) | | $H_2$ 1200 psi (cold) ($H_2$ Treat 7.2 wt %) | |
|---|---|---|---|---|
| (wt %) daf coal) | L | AO/CO + L | L | AO/CO + L |
| $CO_x$ | 14.7 | 13.9 | 11.8 | 13.7 |
| $C_1$–$C_3$ | 5.5 | 3.9 | 5.8 | 4.4 |
| Liquids + $H_2O$ | 38.0 | 55.2 | 48.3 | 61.4 |
| Total Conv. | 55.8 | 70.9 | 62.3 | 76.9 |
| $H_2$ Consumption | −2.3 | −2.1 | −3.5 | −2.5 |

EXAMPLE 6

This Example illustrates the effect of pretreatment conditions (temp., time, water/coal ratio) on the liquefaction reactivity of the pretreated coal in long residence time (4 hours) once-through liquefaction experiments. The long liquefaction reaction time was chosen to best simulate bottoms recycle which provides long residence time for bottoms conversion.

Decreasing the reaction time in the aqueous CO pretreatment stage to 1 hour at 625° F. or 650° F. significantly decreased the conversion of the coal. Further increasing the pretreatment time from 2 to 4 hours at 650° F. increases the conversion slightly.

For all of the data discussed above, water/daf coal ratios of 3.3–3.7 and CO treats of 4.6–6.0% on a hydrogen equivalent were used in the pretreatment stage. At 550° F., it was possible to decrease the water/daf coal ratio to 1/1 and to cut the CO treat in half without debiting conversion. Further reductions in CO and water, however, did begin to decrease conversion. At 600° F. and 650° F., it was not possible to cut down the water and CO charges as low as in the 550° F. case without significantly decreasing conversion. This may be due to the larger amount of water-gas-shift and the greater amount of water that is vaporized at the higher temperatures.

Figure 7:
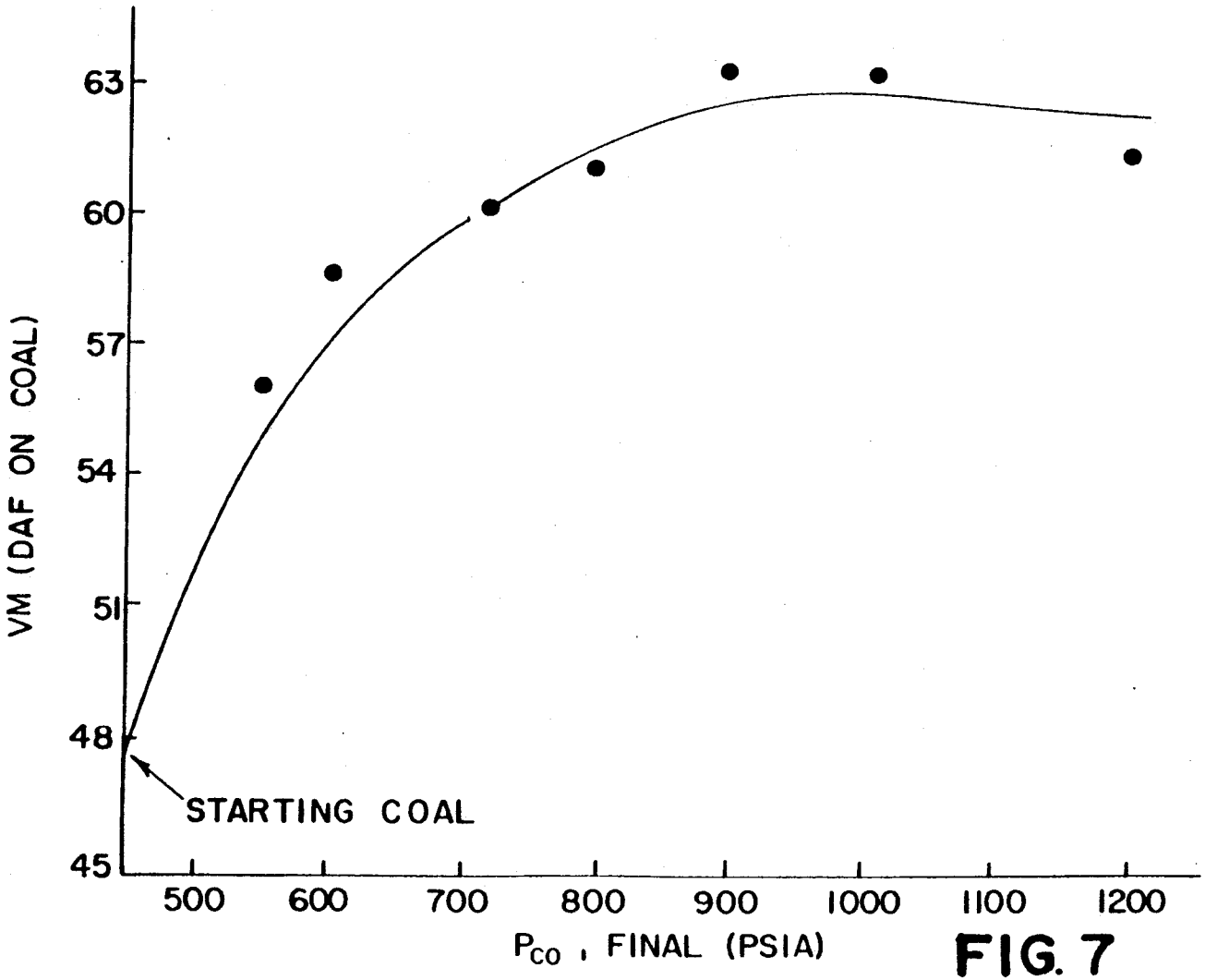
FIG. 7 shows the effect of carbon monoxide partial pressure during pretreatment on the volatile matter content of coal.

In the examples given, volatile matter (at 850° C., in nitrogen) is taken as the sum of the volatile content of the residue recovered after pretreatment and the converted material during the pretreatment itself (mostly $CO_2$ and $H_2O$). The CO partial pressure is calculated from the total pressure and an analysis of the gases present at the end of the experiment. FIG. 7 illustrates that an increase in the final partial pressure of CO in a batch tubing bomb directly correlates with the observed improvement in total volatile matter. However the maximum quality coal is produced with a CO partial pressure of approximately 850-1000 psia.

EXAMPLE 7

This example further illustrates the effect of pretreat conditions on the liquefaction reactivity of the treated coal (CO partial pressure). The CO partial pressure also influences how fast a given quality coal is produced. In a batch tubing bomb, water: coal ratio of 2:1, temperature of 625° F., Rawhide coal. As an example of how this can be used, under the conditions examined, it was found that a total product volatile matter content of 55.6% can be achieved in 2 hours at 535 psia CO, 1.2 hours at 890 psia or 0.7 hours at 1380 psia. Alternatively, the total volatile matter content can be increased from 55.6% to 57.9% or 60.7% respectively for the three pressures measured. In summary, the aqueous/CO treatment of coal for subsequent liquefaction can be significantly improved by optimizing the CO partial pressures to yield an improved quality product or by trading increased CO partial pressures for a reduction in residence time.

EXAMPLE 8

Figure 8:
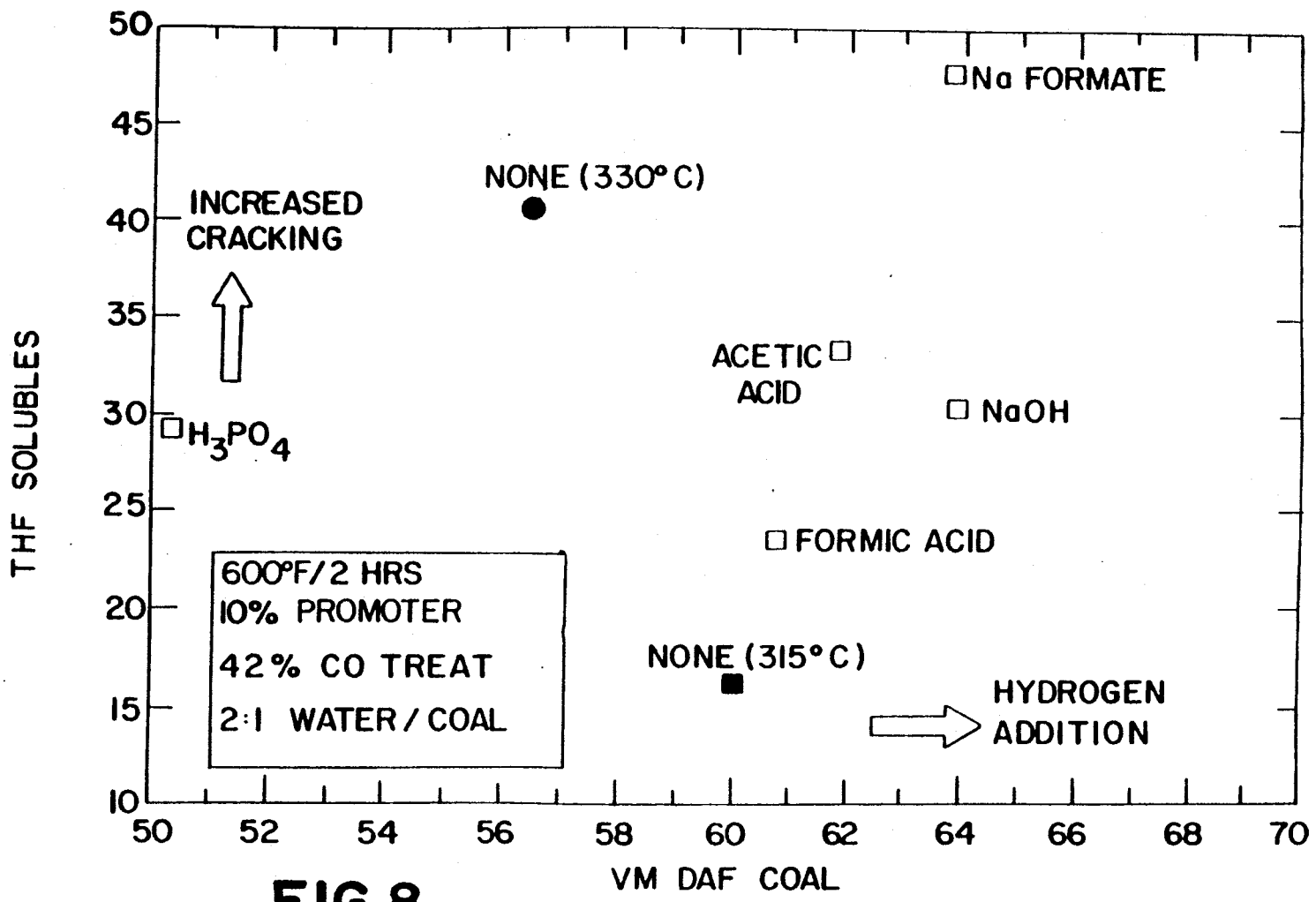
FIG. 8 shows the effects of various promotors on the solubility and volatile matter content of coals during pretreatment according to the present invention.

This example illustrates the effects of added catalytic promoters on pretreatment of coal, at 600° F. where greater hydrogenation of the coal takes place. In these initial studies a large amount of promoter was used to screen the response of the system. Reactions were carried out at 600° F. using 10 wt. % catalyst at a standard 42% CO treat rate with a 2:1 water/coal ratio. The results provided in Table 1 above show volatile matter, which correlates with H/C ratio and liquefaction conversion, and THF solubles, which indicates the degree of cracking or depolymerization. FIG. 8 shows the effect of promoters on THF solubility versus volatile matter in order to provide mechanistic insights on the dual reaction pathways effected by the various promoters. Table 8 below shows the effect of promoters on coal properties.

TABLE 8

Reaction conditions: 2 hrs/42% CO on dry coal/ 2:1 water-to-coal/600° F./10% promoter on dry Rawhide coal

| Promoter | THF Sol. (daf) | VM (daf) | H/C |
|---|---|---|---|
| None | 17.7 | 49.5 | 0.937 |
| Sodium formate | 51.5 | 53.6 | 0.978 |
| Acetic acid | 36.1 | 50.7 | 0.935 |
| Sulfuric acid | 36.2 | 43.5 | 0.834 |
| Sodium hydroxide | 35.3 | 46.9 | 0.963 |
| Calcium iodide | 32.7 | 51.0 | 0.948 |
| Formic acid | 23.9 | 51.4 | 0.962 |

TABLE 8-continued

Reaction conditions: 2 hrs/42% CO on dry coal/ 2:1 water-to-coal/600° F./10% promoter on dry Rawhide coal

| Promoter | THF Sol. (daf) | VM (daf) | H/C |
|---|---|---|---|
| Carbon disulfide | 33.1 | 51.0 | 0.968 |
| Calcium hydroxide | 38.9 | 52.3 | 0.941 |
| Calcium acetate | 43.0 | 50.6 | 0.944 |
| Calcium oxide | 37.9 | 53.0 | 0.934 |
| Sodium sulfite | 45.4 | 50.7 | 0.984 |

For the unpromoted case a product with ~60% VM and ~16% THF solubles is produced. Increasing the temperature to 625° F. gives a large increase in the solubles, due to an increased cracking contribution at the higher temperature, and a lower VM content as expected. Returning to the 625° F. runs, addition of phosphoric acid, an acid catalyst, gives some increase in THF solubles, but without a hydrogenation component the VM content of the product is dramatically decreased. Formic acid, both an acid and an hydrogenation catalyst shows small increases in both components. Sodium hydroxide helps stabilize formate ion as the sodium salt and facilitates the reducing ability of the system, whereas direct addition of sodium formate is clearly the best catalyst giving a 4% increase in VM, which would be expected to correspond to >5% increase in liquefaction yield. Acetic acid increases the acid catalyzed component of the system and generates some soluble calcium acetate by ion exchange with the calcium carboxylates in the Rawhide coal, which in turn helps stabilize some of the formic acid formed from $CO/H_2O$ as calcium formate. The reason that phosphoric acid only produces an increase in THF solubles and a reduction in VM content is because ion exchange with the calcium carboxylates produces insoluble calcium phosphate which is unavailable for stabilization of formate ion. Mechanistically, reduction reactions increase the VM and H/C atomic ratio in the coals. The increased depolymerization, as monitored by increased THF solubles, is reflected by cleavage reactions on the hydrogenated coal and by direct depolymerization of the raw coal.

It will be understood that while there have been herein described certain specific embodiments of the invention, it is not intended thereby to have it limited to or circumscribed by the details given, in view of the fact that the invention is susceptible to various modifications and changes which came within the spirit of the disclosure and the scope of the appended claims.

What is claimed is:

1. A process for pretreatment of coal preliminary to catalytic hydroconversion of coal material to a hydrocarbonaceous liquid, which process comprises forming in a pretreatment zone a mixture comprising coal, carbon monoxide, solvent and an effective amount of a promoter compound or mixtures thereof, and subjecting the coal containing mixture to a temperature from about 550° F. to 700° F. and a pressure effective to cause hydrogenation and/or depolymerization of the coal, but not to cause solubilization or liquification of said coal, wherein the promoter compound is selected from the group consisting of formic acid, acetic acid, propionic acid, lactic acid, hydrogen sulfide, or an ammonium, alkali or alkali earth metal salt of any of the foregoing acids.

2. The purpose of claim 1, wherein the alkali or alkali earth metal is selected from the group consisting of calcium, magnesium, lithium, sodium or potassium.

3. The process of claim 1, wherein the promoter is formed in-situ as a by-product of the coal.

4. The process of claim 1, wherein the promoter is present in the amount of 0.5 to 50 weight % in said mixture during pretreatment.

5. The process of claim 4, wherein the promoter is is present in the amount of 0.5 to 10 weight %.

6. The process of claim 1, wherein said solvent is an organic solvent.

7. The process of claim 1, wherein said solvent is an aqueous solvent.

8. The process of claim 1, wherein the coal containing mixture is subjected to a temperature from about 550° F. to 650° F.

9. The process of claim 10, wherein the organic solvent is coal derived.

10. The process of claim 1 wherein the water to coal ratio is at least about 0.5 to 1.

11. The process of claim 1, wherein the partial pressure of CO is about 800 to 4500 psi.

12. The process of claim 1, wherein the residence time in the hydroconversion reactor is about 20 minutes to 2 hours.

13. The process of claim 7, wherein an aqueous effluent from the pretreatment zone is recycled such that promoters which are by-products of the pretreatment reactions are accumulated and returned to said pretreatment zone.

14. The process of claim 1 wherein the pretreated coal is reacted with a catalyst under hydroconversion conditions in the presence of hydrogen in a hydroconversion zone to produce hydrocarbonaceous liquids.

15. The process of claim 15, wherein said catalyst comprises a metal selected from Groups VA, VIA, VIIA, and VIIIA of the Periodic Table of the Elements.

16. A process for pretreatment of coal preliminary to catalytic hydroconversion of coal material to a hydrocarbonaceous liquid, which process comprises forming in a pretreatment zone a mixture comprising coal, carbon monoxide, solvent and an effective amount of a promoter compound or mixtures thereof, and subjecting the coal containing mixture to a temperature from about 550° F. to 700° F. and a pressure effective to cause hydrogenation and/or depolymerization of the coal, but not to cause solubilization or liquification of said coal, wherein the promoter compound is selected from the group consisting of hydrogen sulfide, or ammonium sulfide, or ammonium bisulfide.

* * * * *